US007229208B2

(12) United States Patent
Verardo et al.

(10) Patent No.: US 7,229,208 B2
(45) Date of Patent: Jun. 12, 2007

(54) BI-MATERIAL SELF-COMPENSATING BALANCE-SPRING

(75) Inventors: Marco Verardo, Les Bois (CH); Thierry Conus, Lengnau (CH)

(73) Assignee: Nivarox-Far S.A., La Locle (CH)

( * ) Notice: Subject to any disclaimer, the term of this patent is extended or adjusted under 35 U.S.C. 154(b) by 0 days.

(21) Appl. No.: 11/169,911

(22) Filed: Jun. 30, 2005

(65) Prior Publication Data

US 2006/0002241 A1 Jan. 5, 2006

(30) Foreign Application Priority Data

Jul. 2, 2004 (EP) ..... 04015580

(51) Int. Cl.
*G04B 17/04* (2006.01)

(52) U.S. Cl. ..... 368/175

(58) Field of Classification Search ..... 368/175, 368/177, 178

See application file for complete search history.

(56) References Cited

U.S. PATENT DOCUMENTS 209,642 A * 11/1878 Berlitz et al. ..... 368/175
1,931,251 A * 10/1933 Chamberlain ..... 420/43
3,186,157 A * 6/1965 Favret et al. ..... 368/175
3,956,881 A * 5/1976 Vuille et al. ..... 368/177
2002/0167865 A1* 11/2002 Tokoro et al. ..... 368/175

FOREIGN PATENT DOCUMENTS

| | | |
|---|---|---|
| EP | 1 431 844 A1 | 6/2004 |
| EP | 1 445 670 A1 | 8/2004 |
| WO | WO 327 796 | 2/1958 |

* cited by examiner

*Primary Examiner*—Vit W. Miska
*Assistant Examiner*—Thanh S. Phan
(74) *Attorney, Agent, or Firm*—Sughrue Mion, PLLC

(57) ABSTRACT

The balance-spring is formed by a first assembly, comprising the coils (3) and the outer curve (2), made in a first material such as Elinvar having an elastic torque that is insensitive or almost insensitive to elongation, temperature and magnetic field variations, and by a second assembly secured to the first assembly, comprising in particular the inner curve (4) made of a second material essentially selected for its mechanical properties and for the shapeability of said inner curve (4) along the most favourable contour for concentric expansion of the balance-spring, such as a Grossmann curve (14), said second assembly also being able to comprise a collet (5).

7 Claims, 1 Drawing Sheet

BI-MATERIAL SELF-COMPENSATING BALANCE-SPRING

TECHNICAL FIELD

The present invention concerns a balance-spring, in particular for integration into the sprung-balance regulating device of a timepiece, whose inner curve is altered to allow concentric expansion of the coils and thereby improve the isochronism of said timepiece.

BACKGROUND OF THE INVENTION

For a timepiece to have the best possible isochronism, it is necessary to act on the construction parameters of the balance and the balance-spring, and on the choice of materials, in order to improve the intrinsic performance of the regulating device and to compensate for or reduce variations of rate due to variations in external conditions, such as the temperature or magnetic field.

As far as the balance-spring is concerned, the shaping of the outer curve for fastening it directly or indirectly to the balance-cock, the shaping of the inner curve for fastening it to the balance staff to allow concentric development of the coils, and the choice of materials play a determining part as regards isochronism.

The invention concerns more specifically both the shaping of the inner curve and the choice of materials for making the inner curve and the set of coils. In order to attain this object, a well-known solution is to choose a non-magnetic material with a low thermal expansion coefficient and applying the "point of attachment" rule to shape the inner curve of a balance-spring along a particular contour, and particularly along the Grossmann curve. In order to make such a curve at the inner end of a balance-spring, all of whose coils have previously been formed by the known winding technique, it is necessary to rely on a highly qualified labour force, such that this solution is reserved for high precision, top of the range timepieces and for limited series but is not applicable to large scale manufacture. Given the technological development, in order to give the balance-spring the optimum shape, one could envisage making the entire balance-spring by photolithography and galvanic growth. However, in the state of the art, there exists no metal or alloy that is satisfactory both for its electro-plating shapeability and for its properties of elasticity and thermal expansion coefficient.

SUMMARY OF THE INVENTION

It is thus an object of the present invention to offer a new solution by providing a balance-spring able to be manufactured industrially while having the qualities of a Grossmann curve balance-spring whose influence on a concentric expansion of the balance-spring is greater than that resulting from shaping the outer curve.

The invention therefore concerns a self-compensating balance-spring for a sprung-balance regulating device, said balance-spring being formed by a first assembly, comprising the coils and the outer curve, made in a first material having an elastic torque that is insensitive or almost insensitive to elongation, temperature and magnetic field variations, and by a second assembly, comprising in particular the inner curve, made of a second material essentially selected for its mechanical properties facilitating the shaping of said inner curve along the most favourable contour for concentric expansion of the balance-spring. This contour may, for example, be a Grossmann curve.

In order to manufacture the second assembly, known methods can be used, but the LIGA method of photolithography and galvanic growth will preferably be used. Thus, the accuracy of shaping the inner curve is shifted to the making of the irradiation mask, which can be perfectly achieved with current techniques. The mask can easily be duplicated or reused for large-scale manufacture.

By using the LIGA technique to make the second assembly, one can very easily provide a mask for forming the collet for fastening the inner curve to the balance staff at the same time. When the first and second materials are metals or alloys, the first and second assemblies can be assembled by welding, for example by laser welding.

BRIEF DESCRIPTION OF THE DRAWINGS

Other features and advantages of the present invention will appear in the following description, given by way of non-limiting illustration, with reference to the annexed drawings, in which.

DETAILED DESCRIPTION OF THE INVENTION

Figure 1:
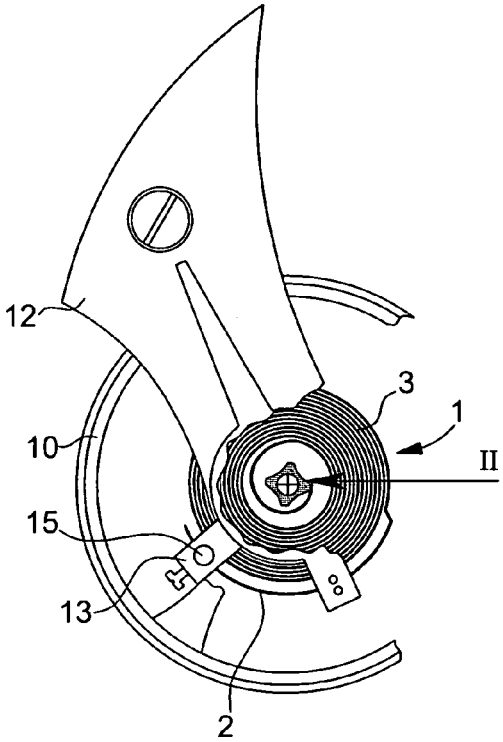
FIG. 1 shows a partially torn away top view of a sprung-balance provided with a balance-spring according to the invention.
Figure 2:
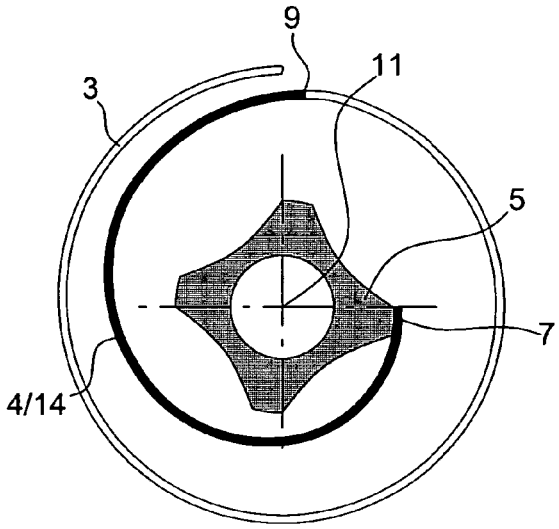
FIG. 2 shows an enlarged view of the inner curve along arrow II of FIG. 1.

FIG. 1 shows a sprung-balance regulating device in a partially torn away top view, limited to the parts useful for comprehension of the invention, FIG. 2 being an enlarged diagram of the centre of the device.

The regulating device includes a balance 10, whose staff 11 pivots in a balance-clock 12 and a balance-spring 1. The outer curve 2 of balance-spring 1 is fastened in a known manner by setting in a balance-cock stud 15 of a balance-spring stud carrier 13, and it is extended by a group of coils 3 as far as the beginning of the inner curve 4 to form a first assembly.

The second assembly, more visible in the enlarged FIG. 2, includes in the example shown inner curve 4 welded at a point 7 to a collet 5. Inner curve 4, which is shown as being a Grossmann curve 14 giving balance-spring 1 concentric expansion, is welded at a point 9 to the end of the coils of the first assembly.

Thus, by "physically" separating the first assembly and the second assembly, it is possible to choose different materials and different manufacturing methods, as a function of the required dominant property.

For the first assembly, the material used can be any alloy known for its non-magnetic properties and its low thermal expansion coefficient, for example Elinvar, this first assembly being able to be shaped for example by winding.

As regards the second assembly, which will preferably be shaped by the LIGA technique, the material used will preferably be selected for its mechanical properties and for its shapeability. Even if the material used does not have all of the required properties for shaping the whole of the balance-spring, given the small length of the inner curve, the impact of such defects on the overall performance of the balance-spring will be negligible and the defects can, in any case, be corrected.

This second assembly can comprise solely the inner curve, which will then be welded at its end 7 to collet 5 and at its end 9 to the end of the coils of the first assembly. When the LIGA method is used, it is possible in an advantageous manner, to form inner curve 14 at the same time as collet 5 giving the latter the conventional shape of four armed star, or any other appropriate shape.

In order to make the second assembly by the LIGA method, in a first step a positive or negative photoresist with a thickness corresponding to the height "h" of the required strip, is spread over a substrate previously coated with a sacrificial layer, then a hollow structure corresponding to the required contour of the second assembly is formed by means of a mask by photolithography and chemical etching. In a second step, said hollow structure is filled with a metal or an alloy such as NiP, either by electrodeposition as indicated for example in U.S. Pat. No. 4,661,212, or by pressing or sintering nanoparticles, as indicated for example in U.S. patent application Ser. No. No. 2001/0038803. In a last step the second assembly is released by removing the sacrificial layer.

Figure 3:
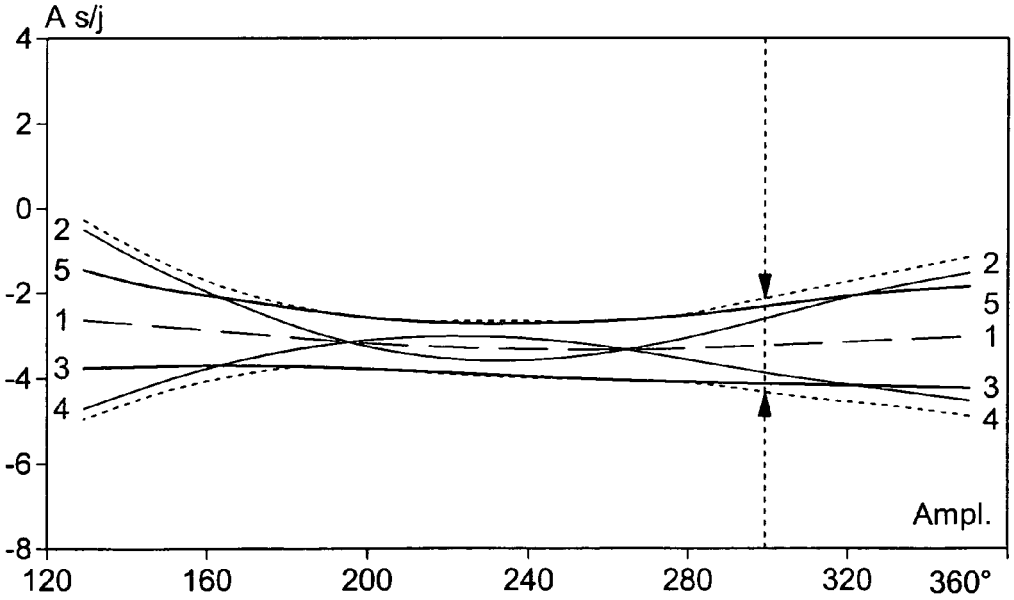
FIG. 3 shows an isochronism diagram obtained with a balance-spring according to the invention.

With reference now to FIG. 3, there is shown the isochronism diagram of a bimaterial self-compensating balance-spring having the aforementioned features.

The abscissa shows the oscillation amplitude of the balance expressed in degrees with respect to its position of equilibrium, and the ordinate shows the rate variation expressed in seconds per day. This diagram includes five curves corresponding to the usual measurement positions (1: horizontal; 2 to 5: the four vertical positions), and the dotted line corresponds to the envelope of all the most unfavourable positions. Usually, the maximum envelope variation for an amplitude comprised between 200° and 300° is retained for the rate variation. As can be seen in FIG. 3, the maximum variation corresponds to an amplitude of 300° and has the value of 2.1 seconds per day, namely approximately one third of the variation observed with an unaltered reference balance-spring, i.e. made of a single material and with no Grossmann curve.

Other alterations to the bimaterial self-compensating balance-spring that has just been described can be made by those skilled in the art without departing from the scope of the present invention.

What is claimed is:

1. A self-compensating balance-spring for a sprung-balance regulating device whose outer curve is secured to a balance-cock in which a balance staff pivots, on which an inner curve of the balance-spring is secured, wherein the balance-spring is formed by a first assembly, including coils and the outer curve, made of a first material having an elastic torque that is insensitive or nearly insensitive to elongation, temperature and magnetic field variations, and by a second assembly secured to the first assembly, including in particular the inner curve made of a second material different than the first material, essentially selected for its mechanical properties facilitating the shaping of said inner curve along the most favourable contour for concentric expansion of the balance-spring.

2. The balance-spring according to claim 1, wherein the inner curve has the contour of a Grossmann curve.

3. The balance-spring according to claim 1, wherein the second assembly also includes a collet for securing to the balance staff and integral with the inner curve.

4. The balance-spring according to claim 1, wherein the first assembly is an Elinvar type alloy, and the material of the second assembly is selected essentially for its mechanical properties and its shapeability, such as a NiP alloy.

5. The balance-spring according to claim 4, wherein the first and second assemblies are secured by a laser welding point.

6. A method of manufacturing the self-compensating balance-spring for a sprung-balance regulating device according to claim 1, wherein the second assembly is made by forming a mould by the LIGA method corresponding to the required contour of the second assembly and adding the second material to said mould by galvanic growth of a metal or an alloy.

7. A method of manufacturing the self-compensating balance-spring for a sprung-balance regulating device according to claim 3, wherein the second assembly is made by forming a mould corresponding to the required contour of the second assembly comprising the inner curve and the collet is formed by the LIGA method and adding the second material to said mould by galvanic growth.

* * * * *